United States Patent [19]

Greenberg

[11] Patent Number: 4,763,839

[45] Date of Patent: Aug. 16, 1988

[54] WATER SPRINKLER

[75] Inventor: Ilan Greenberg, Haifa, Israel

[73] Assignees: Plastro Gvat, Kibbutz Gvat; Agroteam Consultants Ltd., Ramat Yishai, both of Israel

[21] Appl. No.: 7,105

[22] Filed: Jan. 27, 1987

[30] Foreign Application Priority Data

Jan. 31, 1986 [IL] Israel ..... 77746

[51] Int. Cl.[4] ..... B05B 3/08

[52] U.S. Cl. ..... 239/222.17; 239/233; 239/242

[58] Field of Search ..... 239/231–233, 239/498, 505, 516, 253–255, 214, 222.11, 222.13, 222.15, 222.17, 222.21, 242

[56] References Cited

U.S. PATENT DOCUMENTS

| | | | |
|---|---|---|---|
| 1,730,623 | 10/1929 | Orr | 239/231 |
| 2,785,013 | 3/1957 | Stearns | 239/498 |
| 2,816,798 | 12/1957 | Royer | 239/233 |
| 3,009,648 | 11/1961 | Hait | 239/222.17 |
| 3,088,678 | 5/1963 | Turner | 239/231 |
| 3,871,582 | 3/1975 | Biddle | 239/233 |
| 4,611,760 | 9/1986 | Koresh | 239/233 |
| 4,669,663 | 6/1987 | Meyer | 239/233 |

*Primary Examiner*—Andres Kashnikow
*Assistant Examiner*—Kevin Patrick Weldon
*Attorney, Agent, or Firm*—Benjamin J. Barish

[57] ABSTRACT

A sprinkler comprises a nozzle and a distributor head mounted for both rotary and lateral movements with respect to the nozzle. The distributor head has two passageways formed such that when it receives the water jet in one or the other passageway, it directs the jet outwardly of the distributor head with the water applying a force tending to rotate the distributor head in one or the other direction. The sprinkler further includes an abutment, a first stop engageable by the abutment when the distributor head is rotated in the one direction by the flow of water through the first passageway to move the distributor head laterally of the nozzle to align its second passageway with the nozzle, and a second stop engageable by the abutment when the distributor head is rotated in the opposite direction by the flow of water through the second passageway to move the distributor head laterally of the nozzle to align its first passageway with the nozzle.

15 Claims, 3 Drawing Sheets

FIG 1
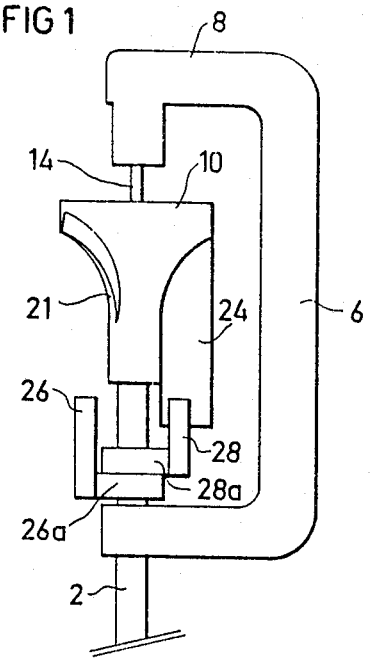
FIG. 2
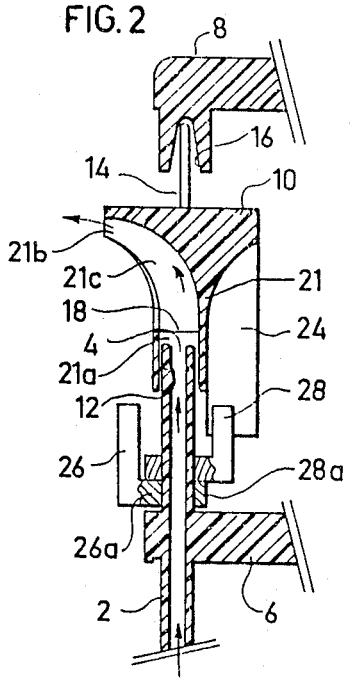
FIG. 3
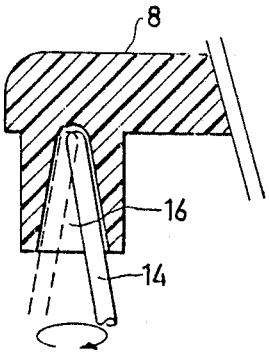
FIG. 4
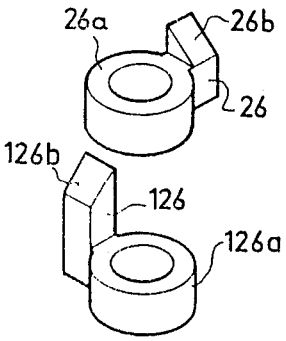
FIG 4a
FIG. 4b
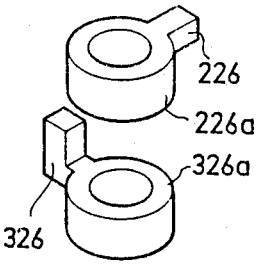
FIG 4c FIG 5
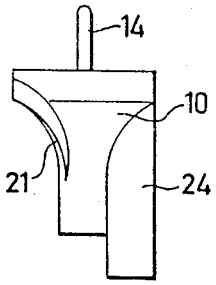
FIG 5a
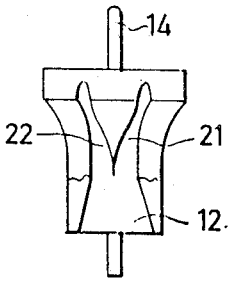
FIG 5b
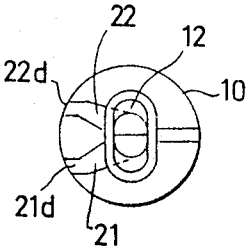
FIG 6
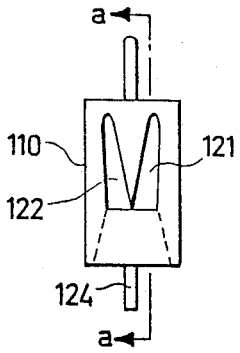
FIG 6a
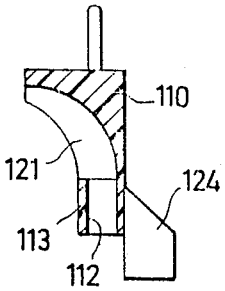
FIG 6b
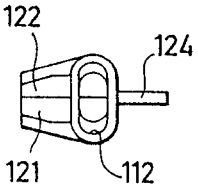
FIG 7
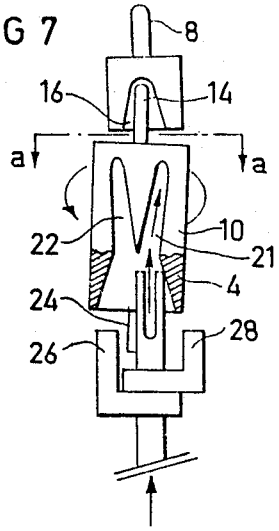
FIG 7a
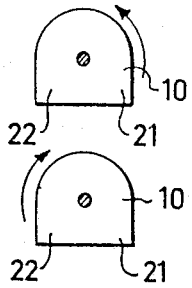
FIG 7b

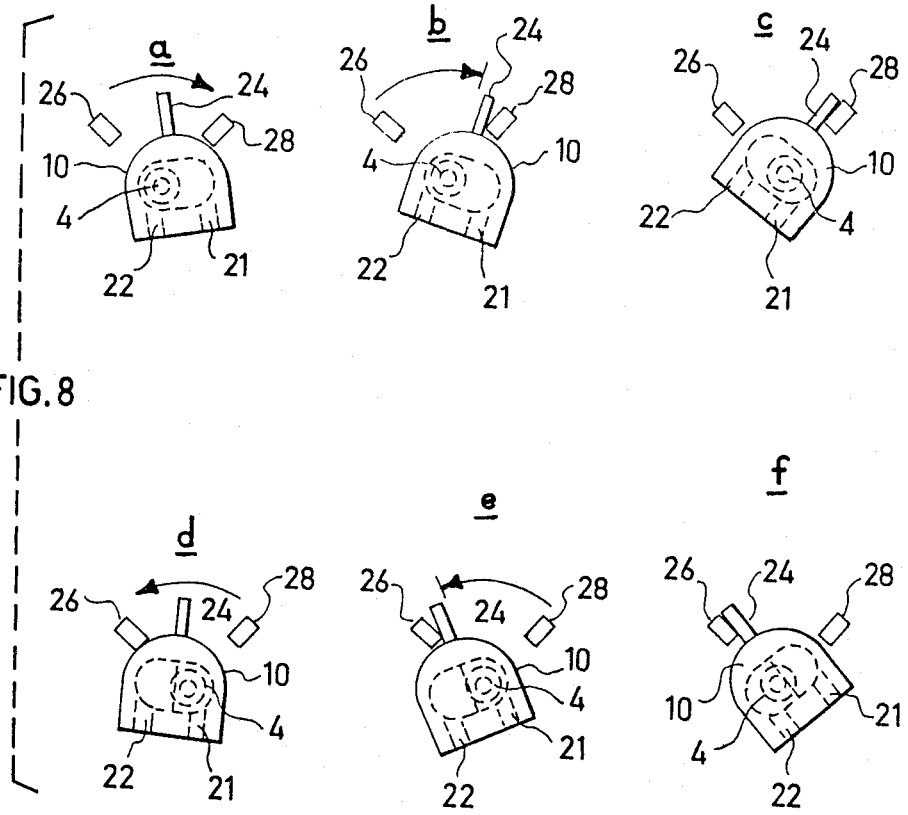
FIG. 8
FIG 9a
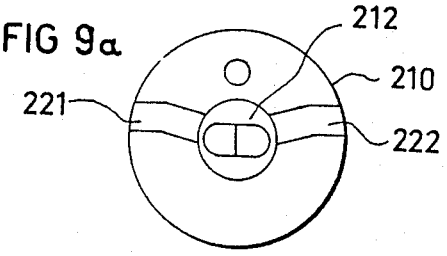
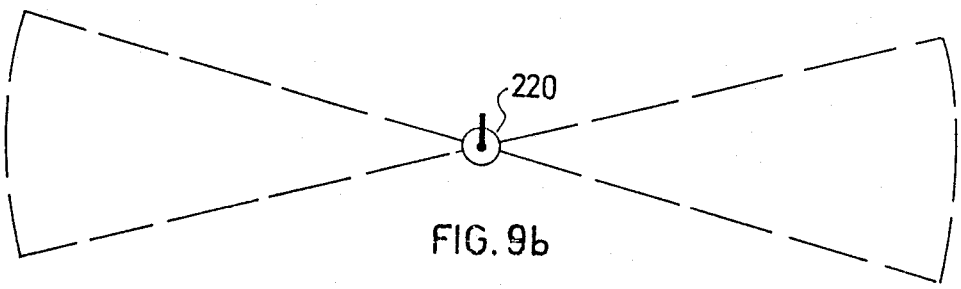
FIG. 9b

WATER SPRINKLER

RELATED APPLICATIONS

The present application is related to my patent application Ser. Nos. 07/006,966 and 07/006,999, both filed the same day as the present application and assigned to the same assignee as the present application.

BACKGROUND OF THE INVENTION

The present invention relates to water sprinklers, and particularly to water sprinklers which can be operated as a sector-type sprinkler, to wet only a predetermined sector, or as a conventional full-circle sprinkler.

Sector-type water sprinklers are commonly used where it is desired to distribute the water over a predetermined sector, rather than completely around the sprinkler. The predetermined sector may be, for example, the location of a tree to be irrigated by the water, or the outer edge or corner of a land plot to be irrigated. Many sector type sprinklers have been designed and are now in use, but efforts are continuously being made to simplify their construction so as to permit their manufacture and assembly in volume and at low cost.

SUMMARY OF THE INVENTION

An object of the present invention is to provide a new sprinkler constructed of a few relatively simple parts which can be manufactured and assembled in volume and at relatively low cost.

According to the present invention, there is provided a water sprinkler comprising a nozzle connectable to a water supply pipe for discharging the water therefrom in the form of a water jet along the nozzle axis; and a distributor head in the path of the water jet and mounted for rotary movement about the nozzle axis and for lateral movement laterally of the nozzle axis. The side of the distributor head facing the nozzle is formed with a first curved groove including an axially-extending inlet end facing and normally aligned with the nozzle, a radially-extending outlet end, and a curved juncture between the two ends such that the curved groove defines a first passageway for receiving the water jet and for directing it outwardly of the distributor head with the water applying a force tending to rotate the distributor head in one direction. The distributor head is further formed with a second groove also including an axially-extending inlet end facing a alignable with the nozzle, a radially-extending outlet end, and a curved juncture between the two ends such that the curved groove defines a second passageway for receiving the water jet and for directing it outwardly of the distributor head with the water applying a force tending to rotate the distributor head in the opposite direction. The water sprinkler further includes an abutment; a first stop engageable by the abutment when the distributor head is rotated in the one direction by the flow of water through the passageway, to move the distributor head laterally of the nozzle axis to align the inlet end of its second passageway with the nozzle; and a second stop carried by the nozzle so as to be engageable by the abutment when the distributor head is rotated in the opposite direction by the flow of water through the second passageway to move the distributor head laterally of the nozzle axis to align the inlet end of its first passageway with the nozzle.

In the preferred embodiments of the invention described below, the stops are manually presettable to preset the sector of water distribution; if the stops are disabled, either by their removal or by the removal of the abutment, the sprinkler acts as a conventional rotary sprinkler and distributes the water completely around the sprinkler.

According to further features in the described preferred embodiments, the distributor head is formed with an inlet chamber of oval configuration communicating on one side with the inlet to the first passageway, and on the opposite side with the inlet to the second passageway. The outer end of the nozzle is received within the inlet chamber, and the distributor head is movable laterally of the nozzle to align the first or second inlet with the nozzle.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a side elevational view illustrating one form of sector-type sprinkler constructed in accordance with the present invention;

FIG. 2 is a longitudinal sectional view of the sprinkler of FIG. 1;

FIG. 3 is an enlarged fragmentary view illustrating a portion of the mounting of the distributor head in the sprinkler of FIG. 1 to permit both rotary and lateral movements of the distributor head;

FIG. 4 illustrates the construction of one of the preset stops in the sprinkler of FIG. 1, and FIGS. 4*a*–4*c* illustrate variations;

FIG. 5 is a side elevational view illustrating the distributor head in the sprinkler of FIG. 1, and FIGS. 5*a* and 5*b* illustrate front and bottom views, respectively;

FIG. 6 is a front view illustrating a modification in the construction of the distributor head; FIG. 6*a* is a sectional view along lines a—a of FIG. 6; and FIG. 6*b* is a bottom view of the distributor head of FIG. 6;

FIG. 7 diagrammatically illustrates the operation of the sprinkler, FIG. 7*a* being a view along lines a—a of FIG. 7, and FIG. 7*b* being a view similar to that of FIG. 7*a* but when the sprinkler reverses direction;

FIGS. 8*a*, 8*b*, 8*c*, 8*d*, 8*e*, and 8*f* illustrate the overall operation of the sprinkler of FIG. 7; and FIG. 9*a* illustrates a modification in the distributor head, and FIG. 9*b* illustrates the wetting pattern produced by this modification.

DESCRIPTION OF PREFERRED EMBODIMENTS

The sprinkler illlustrated in FIGS. 1 and 2 comprises a vertically extending tube 2 connectable to a water supply pipe (not shown) and discharging the water in the form of a jet via a nozzle 4 along the vertical axis of the sprinkler. Tube 2 carries a bracket 6 formed with an arm 8 overlying nozzle 4. A distributor head 10 is mounted between nozzle 4 and bracket arm 8. Distributor head 10 receives the vertical water jet from nozzle 4 and directs it outwardly of the sprinkler so as to distribute the water laterally of the sprinkler.

Distributor head 10 is floatingly mounted to the sprinkler so as to be movable in the rotary, lateral and axial directions with respect to the nozzle 4. For this purpose, the lower end of the distributor head is formed with an inlet chamber 12 receiving nozzle 4, and with an upper stem 14 receivable within a socket 16 formed in bracket arm 8. Inlet chamber 12 of distributor head 10 includes a wall 18 engageable with the upper end of nozzle 4.

The arrangement is such that when no water flows through the nozzle, the distributor head 10 rests by gravity on the upper end of the nozzle; and when water flows through the nozzle, the force of the water lifts the distributor head to bring the upper tip of its stem 14 into engagement with the bottom of the bracket arm socket 16, as shown in FIG. 2. Socket 16 is outwardly flared to permit lateral movement, as well as rotary and axial movements, of the distributor head, as shown particularly in FIG. 3.

Distributor head 10 is formed with two passageways, designated 21 and 22 (FIGS. 5*a*, 7), adapted to receive the water jet from nozzle 4 according to the lateral position of the distributor head with respect to the nozzle. FIG. 2 illustrates the shape of passageway 21, wherein it will be seen that it includes an axially extending inlet 21*a*, a radially extending outlet 21*b*, and a curved juncture 21*c*. As shown particularly in FIG. 5*b*, passageway 21 further includes an impingement surface 21*d* at the outlet end 21*b* (FIG. 2) which is impinged by the water jet exiting from the outlet end such that the impinging water jet applies a force tending to rotate the distributor head in one direction. In the arrangement illustrated in FIG. 5*b*, the water jet issuing from passageway 21 would tend to rotate the distributor head counter-clockwise.

Passageway 22 is similarly formed with an axially-extending inlet joined to a radially-extending outlet by a curved juncture, and with an impingement surface 22*d* but oriented to rotate the distributor head in the opposite direction, i.e. clockwise in FIG. 5*d*, by the impingement thereon of the water flowing through passageway 22.

Distributor head 10 further includes a post 24 integrally formed with the distributor head and depending below it. This post serves as an abutment and is selectively engageable with a pair of stops 26, 28 presettable on tube 2 on opposite sides of the abutment. Stops 26, 28 are manually presettable in order to fix the sector to be wetted by the water from the sprinkler.

As shown particularly in FIGS. 5*a*, 5*b* and 7, inlet chamber 12 receiving the upper end of nozzle 4 is of oblong configuration to permit lateral movement, as well as rotary movement, of the distributor head 10 when the water flows through one or the other of passageways 21, 22. This lateral and rotary movement of the distributor head is also permitted by the shape of the bracket arm socket 16 as described above and as illustrated in FIG. 3.

When the distributor head is located to align its passageway 21 with nozzle 4, as shown in FIG. 7, the distributor head is rotated in the counter-clockwise direction as shown diagrammatically by the arrows in FIG. 7*a*; and when the distributor head is located to align its passageway 22 with nozzle 4, the distributor head is rotated in the clockwise direction as diagrammatically shown by the arrows in FIG. 7*b*. During the rotation of the distributor head in the counter-clockwise direction (FIG. 7*a*), its abutment 24 engages stop 26 causing the distributor head to be shifted laterally to align its passageway 22 with nozzle 4 and thereby to rotate the distributor head in the clockwise direction (FIG. 7*b*) until abutment 24 engages stop 28, at which time the distributor head will be moved laterally back to its original position aligning its passageway 21 with nozzle 4.

The overall operation of the sprinkler will be better understood by reference to FIG. 8. Thus, condition a illustrates the condition wherein the inlet of passageway 22 is aligned with nozzle 4 so that the discharge of the water jet from passageway 22 rotates distributor head 10 in the clockwise direction, until abutment 24 limits against stop 28 (condition b), at which time the distributor head is moved laterally (condition c) to align its passageway 21 with nozzle 4. The water jet then rotates the distributor head 10 in the counter-clockwise direction (condition d) until its abutment 24 engages stop 26 (condition e), at which time the distributor head is shifted laterally (condition f) again to align its passageway 22 with nozzle 4 to repeat the cycle.

It will thus be seen that, when the water is turned on, the distributor head 10 will be lifted off the nozzle and then oscillated back and forth through an arc determined by the settings of stops 26, 28 to distribute the water over the sector defined by these stops.

Stops 26, 28 may be manually preset as desired. Each is integrally formed with a ring 26*a*, 26*b* frictionally received over inlet tube 2 so as to be selectively positioned on opposite sides of abutment 4 carried by the distributor head 10.

FIG. 4 more particularly illustrates the structure of each stop. Thus, with respect to stop 26, it includes a cam surface 26*b* cooperable with the lower end of abutment 24 carried by the distributor head 10. The purpose of cam surface 26*b* is to partially rotate the distributor head 10 to move its abutment 24 away from the stop should the water supply be turned off such that the distributor head stops rotating while abutment 24 is against the stop. This partial rotation of the distributor head in this case better assures restarting of the oscillations of the distributor head when the water is again turned on.

FIGS. 4*a*–4*c* illustrate variations that may be made in the structure of the stop. Thus, as shown in FIG. 4*a*, stop 126 is integrally formed with its ring 126*a* but is longer than stop 26 in FIG. 4 so that its cam surface 126 will be higher and thereby will tend to produce a larger rotary movement of the distributor head should it stop rotating with its abutment 24 against the stop. In FIG. 4*b*, the stop 226 is merely a lug integrally formed with its ring 226*a*; and in FIG. 4*c*, the stop 326 is in the form of a post integrally formed with its ring 326*a*.

FIGS. 6, 6*a* and 6*b* illustrate a possible variation in the structure of the distributor head. Thus, in these figures the distributor head, generally designated 110, is of generally rectangular configuration, whereas in FIGS. 1–5 it is of generally circular configuration. FIGS. 7*a* and 7*b* illustrate a still further variation wherein it is of generally semi-circular configuration.

In addition, in the construction illustrated in FIGS. 6, 6*a*, 6*b*, the inlet chamber 112 is in a depending collar 113 integrally formed with the lower end of the distributor head having the two passageways 121, 122. The abutment 124 carried by distributor head is also integrally formed with the distributor head. In all other respects, the distributor head illustrated in FIGS. 6, 6*a* and 6*b* is constructed and operates in the same manner as described above.

FIG. 9*a* illustrates a modification in the construction of the distributor head, therein designated 210. Here, passageways 221, 222 are disposed in diametrically opposite sides of the distributor head, rather than in the same side as in above-described embodiments. The arrangement illustrated in FIG. *9a* will thus produce the wetting pattern illustrated in FIG. *9b* wherein the water is distributed in two sectors on the opposite sides of the distributor head.

It will thus be seen that the invention provides a sprinkler constructed of relatively few parts which can be produced and assembled in quantity and at low cost. It will also be appreciated that in order to convert the illustrated sprinklers to a conventional rotary sprinkler, wherein the water is distributed in a full circle completely around the sprinkler, it is only necessary to remove one of the stops (26, 28) whereupon the distributor head will oscillate back and forth over 360°, or to remove both of the stops, whereupon the sprinkler will continuously rotate in one direction. Further, the stops may be mounted on the distributor head, and the abutment on the nozzle.

Many other variations, modifications and applications of the invention may be made.

What is claimed is:

1. A sprinkler, comprising:

a nozzle connectably to a water supply pipe and discharging the water therefrom in the form of a water jet along the nozzle axis;

a distributor head in the path of said water jet and mounted for rotary movement about said nozzle axis and for lateral movement laterally of said nozzle axis;

the side of said distributor head facing the nozzle being formed with a first curved groove including an axially-extending inlet end facing and normally aligned with said nozzle, a radially-extending outlet end, and a curved juncture between the two ends such that the curved groove defines a first passageway for receiving the water jet and for directing it outwardly of the distributor head with the water applying a force tending to rotate the distributor head in one direction, and with a second curved groove also including an axially-extending inlet end facing and alignable with said nozzle, a radially-extending outlet end, and a curved juncture between the two ends such that the curved groove defines a second passageway for receiving the water jet and for directing it outwardly of the distributor head with the water applying a force tending to rotate the distributor head in the opposite direction;

an abutment;

a first stop engageable by said abutment when the distributor head is rotated in said one direction by the flow of water through said first passageway, to move the distributor head laterally of the nozzle axis to align the inlet end of its second passageway with the nozzle;

and a second stop engageable by said abutment when the distributor head is rotated in said opposite direction by the flow of water through said second passageway to move the distributor head laterally of the nozzle axis to align the inlet end of its first passageway with the nozzle.

2. The sprinkler according to claim 1, wherein said stops are manually presettable with respect to said abutment to preset the sector of water distribution.

3. The sprinkler according to claim 1, wherein said distributor head is formed with an inlet chamber of oval configuration communicating on one side with the inlet end of said first passageway, and on the opposite side with the inlet end of said second passageway; the outer end of said nozzle being received within said inlet chamber, and the distributor head being movable laterally of the nozzle axis to align either of said inlet ends with the nozzle.

4. A sprinkler, comprising:

a nozzle connectable to a water supply pipe and discharging the water therefrom in the form of a water jet;

a distributor head in the path of said water jet and mounted for both rotary and lateral movements with respect to said nozzle;

said distributor head being mounted between said nozzle and a bracket arm carried by the sprinkler and having a first passageway formed such that when it receives the water jet it directs it outwardly of the distributor head with the water applying a force tending to rotate the distributor head in one direction, and a second passageway formed such that when it receives the water jet it directs it outwardly of the distributor head with the water applying a force tending to rotate the distributor head in the opposite direction;

an abutment;

a first stop engageable by said abutment when the distributor head is rotated in said one direction by the flow of water through said first passageway, to move the distributor head laterally of the nozzle to align its second passageway with the nozzle;

and a second stop engageable by said abutment when the distributor head is rotated in said opposite direction by the flow of water through said second passageway to move the distributor head laterally of the nozzle to align its first passageway with the nozzle.

5. The sprinkler according to claim 4, wherein said bracket arm is formed with a socket, and said distributor head carries a stem received in said socket permitting both rotary and lateral movements of the distributor head.

6. The sprinkler according to claim 4, wherein the nozzle is disposed in alignment with the vertical axis of the sprinkler, and the distributor head mounting also permits vertical movement of the distributor head with respect to the nozzle, whereby the water jet issuing from the nozzle lifts the distributor head with respect to the nozzle and the distributor head drops back by gravity when the water supply to the nozzle is terminated.

7. The sprinkler according to claim 6, wherein said stops are formed with cam surfaces engageable with said abutment to partially rotate the distributor head away from the respective stop should the water supply to the nozzle be terminated while the abutment directly overlies a stop.

8. The sprinkler according to claim 4, wherein each of said passageways formed in the distributor head includes an axially extending inlet joined by a curved juncture to a radially extending outlet.

9. The sprinkler according to claim 4, wherein each of said passageways includes a surface impinged by a jet flowing therethrough for rotating the distributor head in the respective direction.

10. The sprinkler according to claim 4, wherein the distributor head is of generally circular configuration.

11. The sprinkler according to claim 4, wherein the distributor head is of generally rectangular configuration.

12. The sprinkler according to claim 4, wherein the distributor head is of generally semi-circular configuration.

13. The sprinkler according to claim 4, wherein said abutment is a post integrally formed with, and depending from, said distributor head.

14. The sprinkler according to claim 4, wherein first and second passageways are formed in the same side distributor head.

15. The sprinkler according to claim 4, wherein first and second passageways are formed in diametrically opposite sides of the distributor head.

* * * * *